US006745923B2

(12) United States Patent
Julian

(10) Patent No.: US 6,745,923 B2
(45) Date of Patent: Jun. 8, 2004

(54) POURING SPOUT ATTACHMENT WITH AUTOMATIC OPENING FEATURE

(75) Inventor: Randall K. Julian, Newburgh, IN (US)

(73) Assignee: Sig Combibloc International AG, Neuhausen Rhine Falls (CH)

( * ) Notice: Subject to any disclaimer, the term of this patent is extended or adjusted under 35 U.S.C. 154(b) by 0 days.

(21) Appl. No.: 10/203,603

(22) PCT Filed: Jan. 24, 2001

(86) PCT No.: PCT/US01/02307

§ 371 (c)(1),
(2), (4) Date: Aug. 12, 2002

(87) PCT Pub. No.: WO01/60705

PCT Pub. Date: Aug. 23, 2001

(65) Prior Publication Data

US 2003/0000963 A1 Jan. 2, 2003

Related U.S. Application Data

(60) Provisional application No. 60/183,671, filed on Feb. 18, 2000.

(30) Foreign Application Priority Data

Feb. 25, 2000 (EP) ..... 00103429

(51) Int. Cl.[7] ..... B65D 47/10

(52) U.S. Cl. ..... 222/541.6; 220/255.1; 220/258.5

(58) Field of Search ..... 222/541.6; 220/277, 220/278, 255.1, 258.3, 258.4, 258.5

(56) References Cited

U.S. PATENT DOCUMENTS 5,482,176 A * 1/1996 Maietta et al. ..... 220/277
6,223,924 B1 * 5/2001 Ek et al. ..... 220/258.4

* cited by examiner

*Primary Examiner*—Edward K. Look
*Assistant Examiner*—John K. Fristor, Jr.
(74) *Attorney, Agent, or Firm*—Suzan J. Hixon; John F. Salazar; Middleton Reutlinger

(57) ABSTRACT

An automatically opening pour spout fitment to be applied to a container over location where the container wall has a weakened area. The automatically opening fitment is comprised of a cap which is threadably attached to the fitment and which has a depending cam extending downward from the top wall. The fitment is comprised of a annular sidewall which defines a pouring zone and which provides a boundary for a hinged flap. The flap has an upwardly extending cam follower which is engaged by the cam of the cap such that when the cap is removed from the fitment, the cam initially applies a horizontal force on the cam follower to open the package to which the fitment is attached to.

28 Claims, 5 Drawing Sheets

POURING SPOUT ATTACHMENT WITH AUTOMATIC OPENING FEATURE

TECHNICAL FIELD

The present invention relates to pouring devices for containers and more specifically to spout attachments for liquid carrying containers which have an automatic opening feature through use of a spiraling cam depending from the cap and acting directly upon the fitment.

BACKGROUND OF THE INVENTION

Pouring spout attachments have been used for cartons and particularly for liquid carrying containers. These attachments are typically mounted on the outside of cartons surfaces or have flanges which are secured on the interior surface of the carton and extend outward through an opening in the container sidewall. Several prior art patents disclose utilization of a pull tab for opening of this container spout. There are also push in tabs for weakened panel zones within the spouts for opening the container. Such spouts are disclosed in U.S. Pat. Nos. 5,101,999 and 4,934,590.

Other patents are known such that the push-in aspect of the spout for opening of the container has a latch feature such that the push-in flap for the spout remains in the open position. Such a disclosure is found in U.S. Pat. No. 5,833,112. A drawback to these prior art spouts is that they require user intervention for actual opening of the container separate and apart for opening the spout itself, traditionally through either a standard threaded closure or a snap on cover.

Other prior art which automatically punctures or opens the container upon removal of the cap is found in the prior art. These structures however suffer from a drawback in that they require serrated or rough edges to puncture the container wall thereby possibly causing shards to appear in the contents within the container. Such a disclosure is contained within U.S. Pat. No. 5,960,992.

Additional prior art spout fitments incorporate a third insert or blade which is acted upon by an extension of the cap. Inclusion of separate elements which are not integral with the fitment and which require assembly within the design increases the overall costs of production and assembly. Further, tolerance issues between the non-integral pieces may prevent the fitment from acting properly to open the container.

There does not exist in the prior art references an economical and easy to use automatic opening pour spout which attaches to a container such that the user, upon unthreading of the closure, causes the opening of the container without ragged tearing of the container side wall or creating chaff.

SUMMARY OF THE INVENTION

A general object of the present invention is to provide an automatically opening pour spout fitment wherein the user, upon unthreading of the closure, causes the fitment to puncture the container and allow the contents to be readily poured therefrom.

It is another object of the present invention to provide a pour spout fitment wherein user intervention is not required to puncture the container sidewall.

An additional object of the present invention is to provide an automatically opening fitment wherein the auto opening feature provides downward force in a direction which is parallel to the bore of the spout of the fitment.

Another object of the present invention is to provide an automatic opening pour spout fitment wherein the puncturing apparatus does not cause tearing of the carton sidewall or generate foreign material within the container A further object of the present invention is to provide an easy opening fitment wherein even rotational pressure is required to open the container through use of the auto opening feature of the fitment.

Still another object of the present invention is to provide a pour spout fitment wherein the rotational movement of the closure on the pour spout is converted to vertical pressure on the container to adequately open the container and fitment. It is further desirous to have the pour spout fitment remain in the open position once opened by the user.

Still another object of the present invention is to provide a pouring spout fitment wherein the closure on the pour spout is threadably attached to the spout of the fitment and wherein the closure has a tamper indicating band or other frangibly attached indicator to indicate prior opening of the spout. Further, upon opening of the closure by the user, the tamper indicating band is fractured from the closure and the fitment pierces the container and opens it for dispensing of the contents.

These and other objects heretofor stated are met by the automatically opening pour spout fitment of the present invention. The pour spout fitment of the present invention contains a spiral cam depending from the top wall of the closure which engages a cam follower on the hinged flap of the fitment. Upon rotation of the closure, the cam causes even pressure to be applied to the cam follower thereby applying vertical downward pressure on the flap and piercing of the container for opening thereof.

All of the above outlined objectives are met by the automatically opening pour spout fitment of the present invention described herein.

BRIEF DESCRIPTION OF THE DRAWINGS

These and other objects and advantages will become more apparent when references made to the following drawings and the accompanying descriptions.

DETAILED DESCRIPTION OF THE PREFERRED EMBODIMENT

Figure 1:
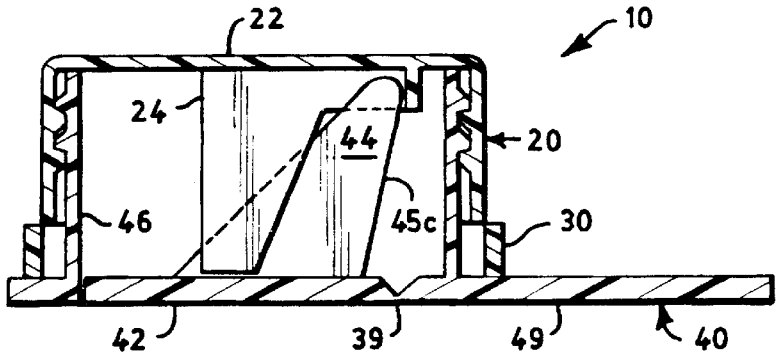
FIG. 1 is a side cutaway view of the pouring spout fitment with automatic opening feature of the present invention.

As shown in FIG. 1, the automatically opening pour spout fitment of the present invention 10 is shown. The pour spout fitment 10 of the present invention is comprised of a threaded cap 20 which threadably engages a fitment 40. As is commonly understood to one of ordinary skill in the art, the fitment 40 is affixed to the sidewall of a container or other carton wherein upstanding sidewall 46 of the fitment extends outward therefrom. Typically, below hinged flap 42 of the fitment 40 is found a weakened portion of the container sidewall, the container not being shown in the figures. This weakened portion allows the flap to rupture the wall and open the carton when downward pressure is applied.

The fitment 40 is comprised of base portion 49, flap 42 and upwardly extending sidewall 46. Extending upward from the hinged flap 42 is cam follower 44 which is more clearly shown in FIG. 2. The design of the automatically opening pour spout fitment 10 shown in FIG. 1 is such that upon rotational movement of cap 20 to remove the cap from the sidewall 46 of the fitment, cam 24, extending downward from the top wall of the cap 20 contacts cam follower 44 causing rotation about the hinge and opening of the container.

With the design of the cam follower 44 and cam 24 of the present invention, opening of the cap 20 causes first downard pressure to achieve tearing of the container and then rotational pressure so that the flap rotates about the hinge. Cam 24 initially operating on back surface 45*c* in order to apply the downward cutting or tearing force. Continued turning of the cap 20 causes the spiral cam 24 to pass upward along the back surface 45*c* and in the last 90 degrees of rotation, in the third quarter turn, the cam 24 acts vertically downward upon the cam follower 44 on the tip portion 45*b*.

For example, in the first portion of turning of the cap 20, i.e. first 180 degrees, the cam follower 24 contacts the vertical edge or back surface 45*c* of the cam 44. As the tip portion 45*b* of the cam follower 44 approaches center of the cap 20 (i.e. it begins to move from right to left as shown in FIG. 1 due to the rotation about hinge 39), the spiral cam 24 passes over the tip portion 45*c* and acts directly downward on the tip for final portion of the opening rotation. Horizontal action is therefore provided upon the vertical or back surface 45*c* to provide downward tearing force on the container and then vertical action is provided on the tip portion 45*c* of the cam follower to allow the flap 42 to enter through the torn portion and fully open the container.

Turning directly to the design of the fitment 40, the fitment is comprised of base 49 which provides an affixation point for the fitment to the container. The base portion 49 may overlay the exterior of the container, may be integrated within the sidewall of the container or may be placed on the interior of the sidewall of the container with the annular sidewall 46 of the fitment 40 extending outward through an annular opening. In any design, a weakened section of the wall of the container is found directly below flap 42 of fitment 40. This weakened section is such that sufficient downward force on flap 42 causes the weakened section to rupture or tear and open the fitment for dispensing of the container through sidewall 46.

Figure 2:
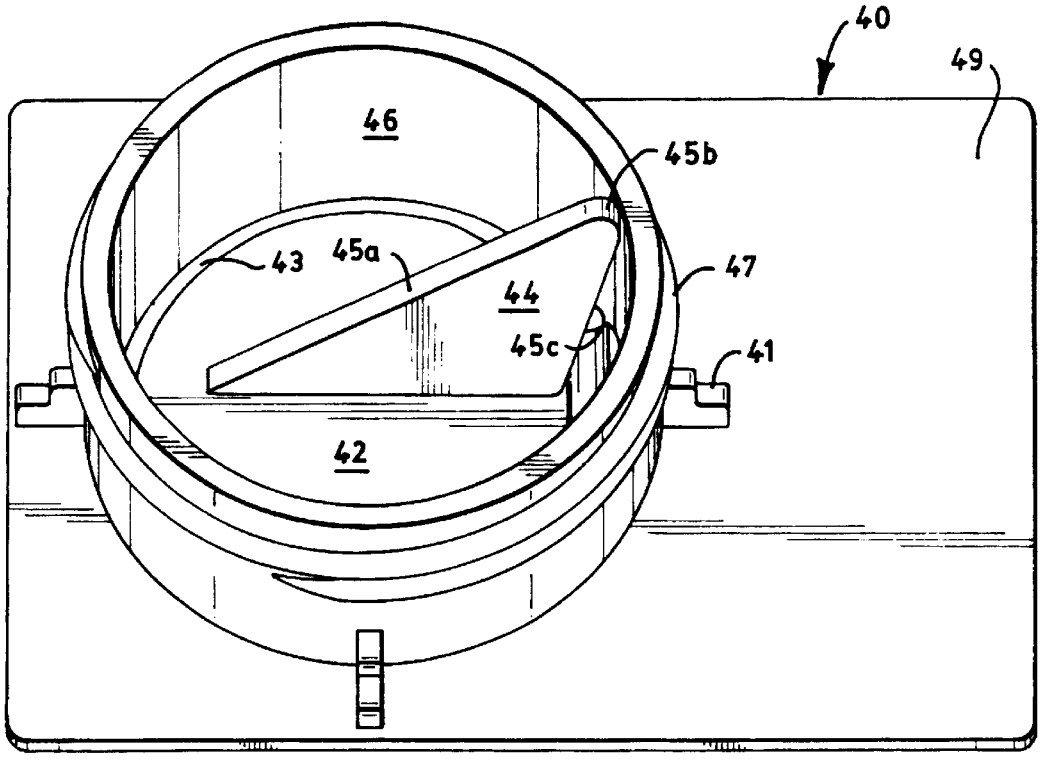
FIG. 2 is a perspective view of the pouring spout fitment of FIG. 1 without the closure attached.

As can be seen in FIG. 2, the fitment 40 may be of rectangular shape and provide sufficient area for affixing the fitment to the container. Annular sidewall 46 extends upward from the base portion 49 and forms a pouring zone there through in order to dispense the contents of the container to which the fitment is attached. The fitment is additionally comprised of a plurality of notch apparatus 41 formed along the conjoining section of the annular sidewall 46 and base 49. Notches 41, shown in FIG. 2 as being separate by 90° along the base of sidewall 46 are positioned so as to contact similar notches formed on a tamper indicating band 30 which depends from a cap 20. Notches 41 will coact with these notches on the cap 20 so that the tamper indicating band 30 will rupture from the lower edge of the cap sidewall and separate therefrom.

Returning to FIG. 2, the fitment 40 further contains at least one helical thread 47 for threadably engaging the cap 20. Upon review of FIG. 2, it is apparent that the fitment 40 has formed within the confines of the pouring zone, defined by the sidewall 46 a flap 42. The flap 42 is hingedly connected to the base 49 via hinge 39. Hinge 39 is defined as a weakened area of the base portion along one segment of the flap such that the flap may rotate about the hinge line thereby entering the container and piercing the weakened portion there below. The flap further contains a cam follower 44 which, as is seen in the Figures, has a slightly triangular shape and extends upward from the flap 42. The cam follower 44 in this embodiment is shown as being perpendicular to the hinge line 39.

The flap 42 of the fitment 40 may generally be about 20 mm in diameter and is separated from the annular sidewall 46 by a slight gap 43 shown in FIG. 2. This gap provides sufficient clearance for the annular flap to rotate about the hinge line 39 and move upward or downward through the pouring zone defined by the annular side wall 46.

The cam follower 44, as described above, is shown as being perpendicular to the hinge line 39 in this example. The cam follower 44 may be placed slightly above the center line of the flap so as to provide a positive angle of attack and engagement via surfaces 45*b* and 45*c*, as outlined above, against the cam 24 and its depending contacting driving edge 23, shown in FIG. 3. Thus, with this particular design, the cam follower allows the cam 24 to provide initial downward force on the flap 42 when the cap 20 is rotated in the counter clockwise direction. Hinge line 39 allows the flap to move downward when the cap 20 is rotated thereby providing sufficient downward force to pierce the weakened container sidewall found below flap 42 and then rotational force to allow the flap to fully open the pouring zone of the fitment.

Figure 3:
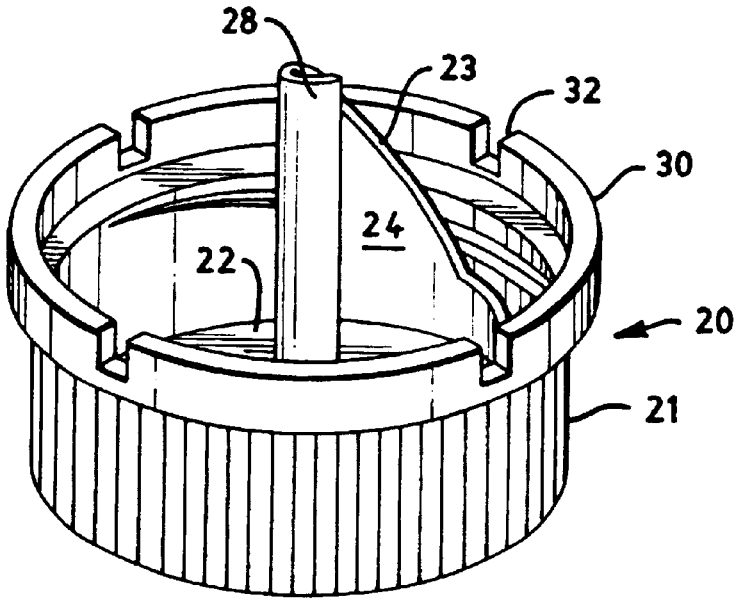
FIG. 3 is a bottom perspective view of the closure shown in FIG. 1.
Figure 4:
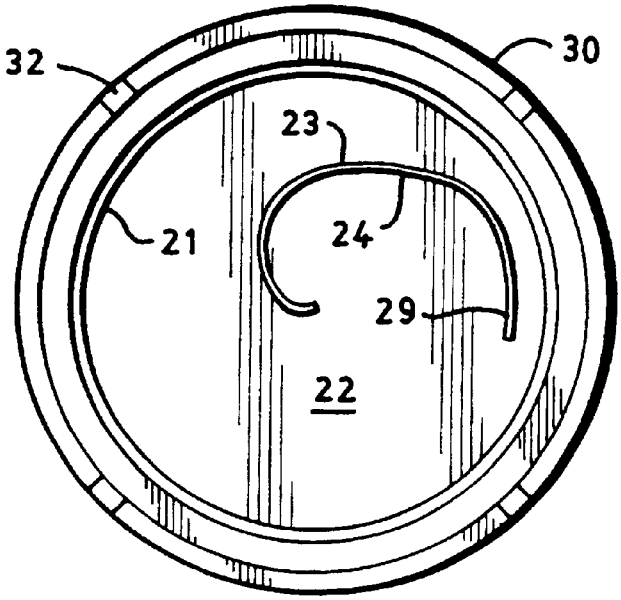
FIG. 4 is a bottom view of the closure shown in FIG. 1.

Turning to FIG. 3, the cap 20 of the present invention which works in conjunction with the fitment 40 is clearly shown with the cam 24 extending away from the top wall 22. The cap 20 is generally comprised of a top wall 22, a sidewall 21 extending downward therefrom and a tamper indicating band 30 which is frangibly attached to the lower edge of sidewall 21. Of particular importance in this design is the spiral cam 24 which provides the downward force on flap 42 of the fitment 40. The cam 24 has center post 28 which, as can be seen from FIG. 4, extends approximately from the center of the top wall 22. The cam 24, spirals in a clockwise fashion from the center post and descends downward to lower portion 29. The cam spirals from the center post 28 to lower portion 29 and has a contacting driving edge 23 which is defined by the width of the spiraling cam 24. Driving edge 23 of the cam 24 engages the cam follower 44 found on flap 42. As previously mentioned, the cam follower 44 is positioned slightly off of the center line of flap 42 so that it positively engages the driving edge 23 of cam 24.

The spiral design of the cam 24 allows the cam to exert downward thrust onto the cam follower 44 along a horizontal plane. As can be seen from the Figures, the spiral cam 24 and cam follower 44 provide a means to provide a downward driving force on the force concentrator which is initially parallel to the direction of the bore of the spout. In other words, the downward force is applied in a direction which extends through the pouring zone of the fitment. Such directional downward force allows the spiral cam design of the present invention to more particularly distribute the downward thrust of the cam as well as provide more leverage against cam follower by the cap 20. Thus, the spiral cam 24 having depending driving edge 23 acts to drive the cam follower 44 along the rear vertical surface 45*c* and tip portion 45*b*. By providing a spiraling depending surface or driving edge 23 in conjunction with engagement surfaces 45*b* and 45*c* of the cam follower, horizontal and rotational pressure is applied to flap 42 ensuring that the side wall of the container located thereunder is adequately pierced by the flap.

As can be seen in FIG. 3, the cap 20 is further comprised of a tamper indicating band 30 which detaches from the sidewall 21 of the cap upon first removal of the cap. The tamper indicating band is provided with a plurality of notches 32 which align directly with notch members 41 formed on the base 49 of the fitment 40. The notches 42 of the cap receive notch members 41 and prevent the tamper indicating band from rotating when rotational force is provided to the cap by the user. Thus, positive indication that the cap has been previously removed is provided.

Figure 5:
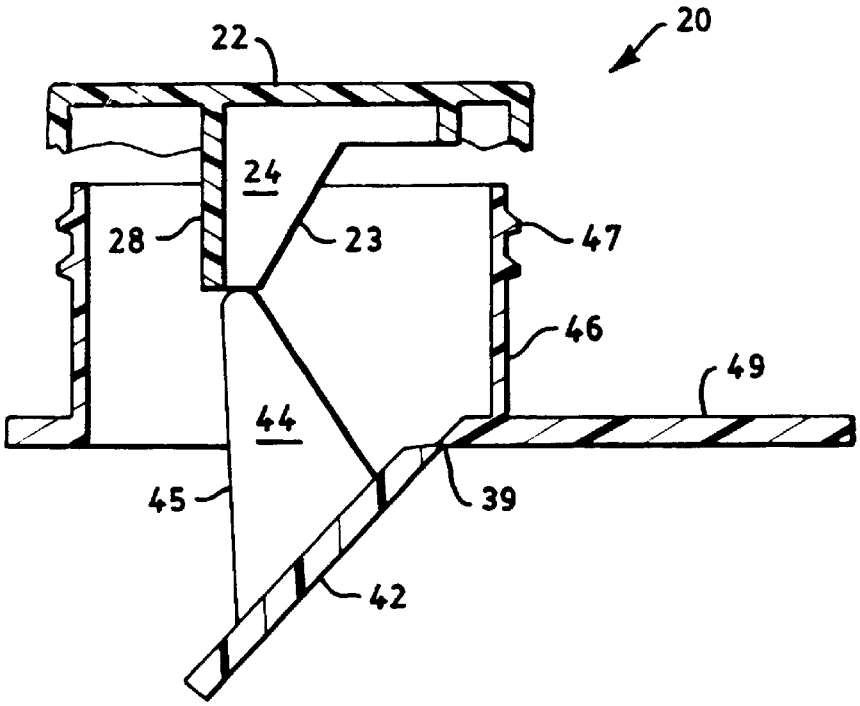
FIG. 5 is a cross-sectional view of the fitment of FIG. 1 with the fitment partially opened.
Figure 6:
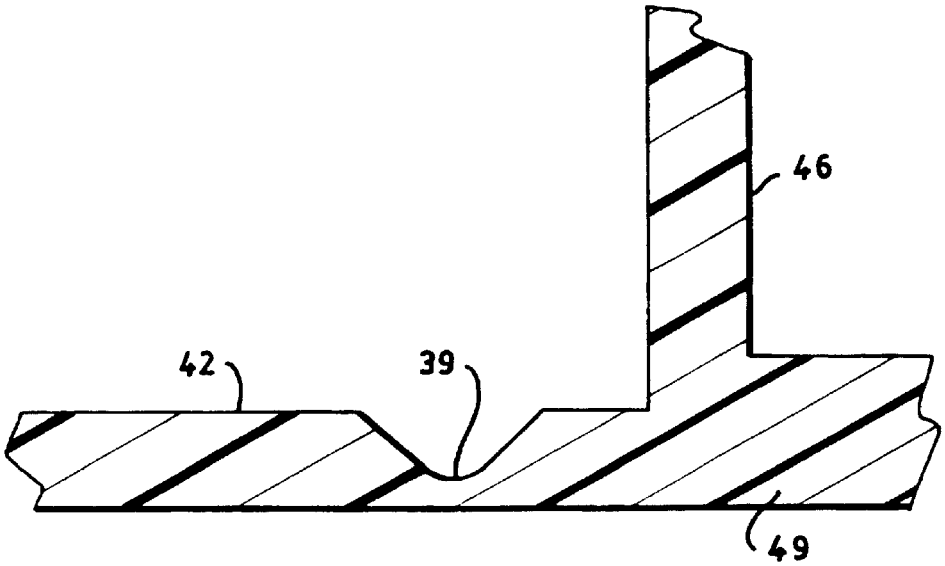
FIG. 6 is a side-sectional view of the fitment shown in FIG. 1 with a closeup of the hinge area.

Turning to FIG. 5, it can be seen that the flap 42 has been pushed downward after the cap 20 has been rotated and removed from annular side wall 46 of the fitment. Reaching the end of its travel, cam 24 is shown passing over the tip portion 45*b* of cam follower 44 and has forced flap into the full downward position as shown. The flap 42 has rotated about the hinge 39, which is more clearly shown in FIG. 6. The hinge 39 is provided along a segment of the flap 42 and is weakened line which, due to its reduced thickness, allows the flap to rotate thereabout. The hinge 39 as is shown in FIG. 6 may be weakened sufficiently that it is less than one half the thickness of the remaining portion of the flap 42 but alternative formations of an adequate hinge are well within the design capabilities of one of ordinary skill in the art.

Returning to FIG. 5, after full counter clock wise rotation of the cap 20, the cam 24 has contacted the cam follower 44 and forced the flap in the downward position. The contents of the container may now be dispensed through the pouring zone which is defined by the side wall 46 of the fitment 40.

Figure 7:
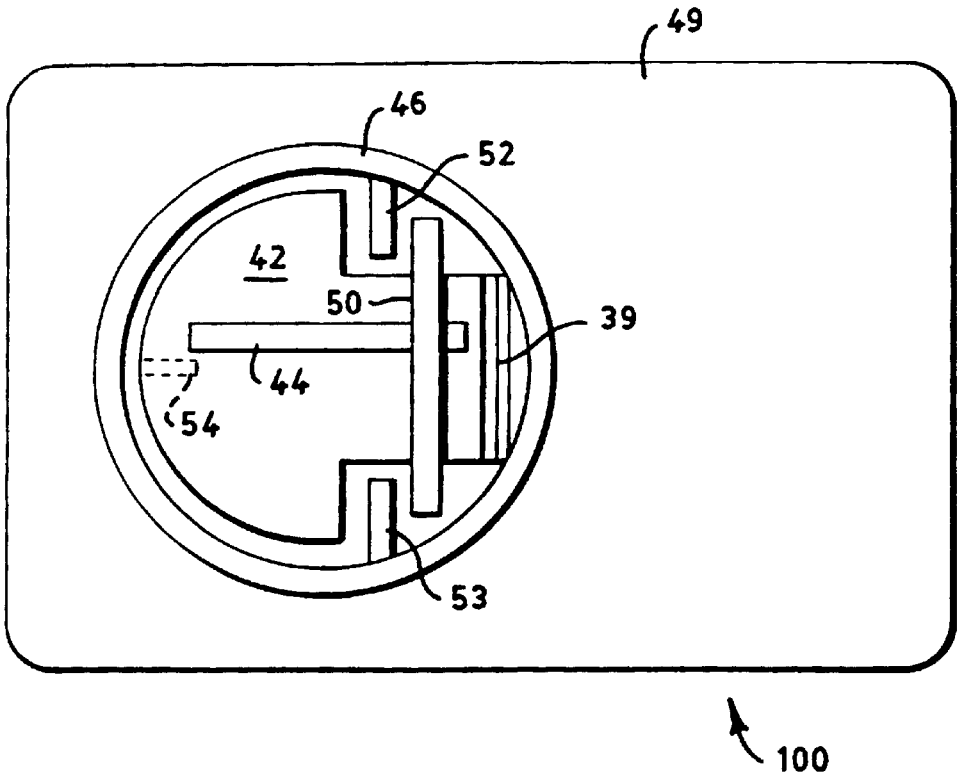
FIG. 7 is a top view of an alternative embodiment for the present invention of the pouring spout fitment.

Turning to FIG. 7, an alternative fitment 100 is shown. In this alternative design, the fitment 100 is provided with a stay open feature so that the flap 42, when pushed in the downward position as was previously shown in FIG. 5, maintains its open position allowing the contents to be poured from the container in routine fashion. The stay open feature of the fitment 100 shown in FIG. 7 is comprised of a shoulder 50 which extends across the flap 42 adjacent to the hinge 39. The shoulder 50 as can be more clearly shown in FIG. 8, extends upward from the flap and rotates forward and downward about the hinge line 39 when rotational force is applied upon the cam follower 44. The downward movement of the shoulder 50 forces it into contact with the stop members 52 and 53 which extend inwardly from the annular sidewall 46 into the pouring zone. Stop members 52 and 53 as are seen in FIG. 7, thereby engage the shoulder 50 after it has rotated downward and, once the shoulder 50 is forced past the stop members 52 and 53, causes the flap to maintain an open position. Therefor, sufficient downward force upon the cam follower 44 is provided by the cam 24 during rotation of the cap such that, when the cam 24 has reached the lower portion 29 thereof, rotation of the cap 20 in the counter clockwise and opening direction eventually causes the cam to force the cam follower 44 downward and the shoulder 50 to by pass the stop members 52 and 53. Thus, even at this lower position of the cam 24 and cam follower 44, sufficient downward force is provided to snap the shoulder 50 past the stop members 52 and 53 so that it maintains an open position.

While a first and a second stop member 52 and 53 are provided, it is readily apparent that unitary stop members or shoulder elements may be provided to sufficiently retain the flap 42 in the open position. Further, alternative stay open features for retaining the flap 42 in the open position after the flap 42 is rotated in the downward direction about the hinge 39 are well within one of ordinary skill in the art to design and implement on the fitment 100 of the present invention.

Figure 8:
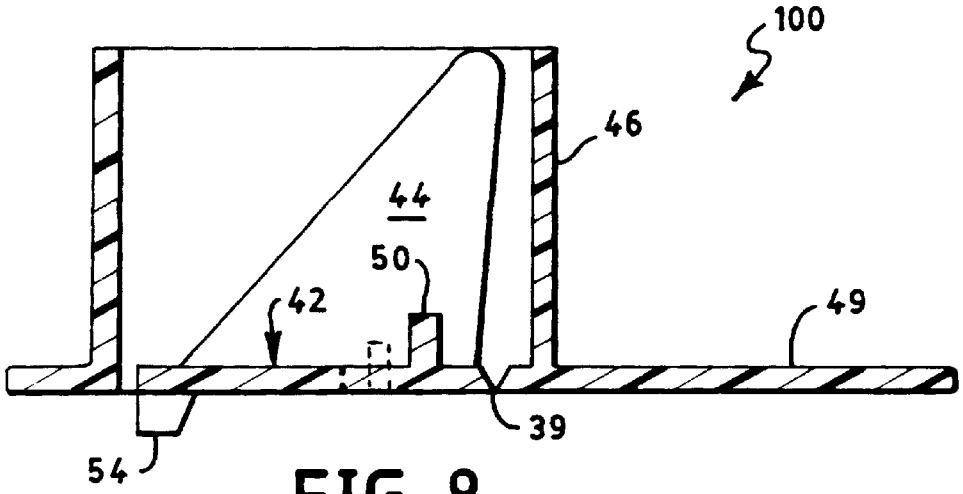
FIG. 8 is a side-sectional view of the alternative embodiment for the pouring spout fitment of FIG. 7.
Figure 9:
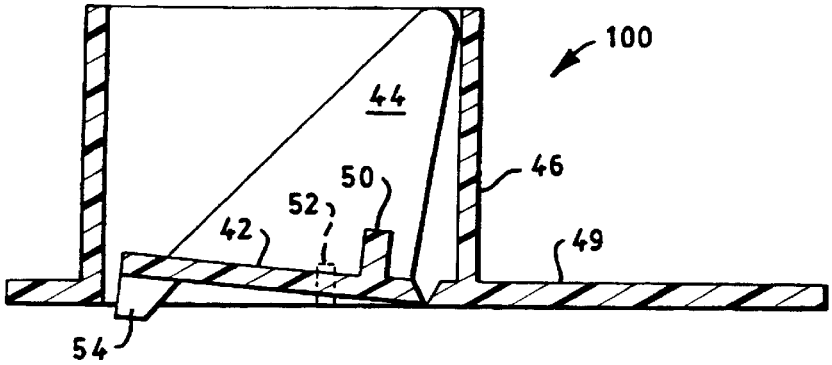
FIG. 9 is a side-sectional view of the pouring spout fitment shown in FIG. 7.

Also shown in FIG. 7 is the force concentrating member 54 which extends downward from the bottom surface of flap 42. In the fitment 100 of the present embodiment, the force concentrating member 54 is designed so that a slightly sharpened portion may extend downward from the flap and provide maximum concentration of force to initiate tearing of the weakened portion directly below the flap 42 along the container wall. Force concentrating member 54 as is shown in FIG. 8, is slightly trapezoidal in shape but may alternatively be triangular or other possible designs. Force concentrating member 54 extends downward from the flap and, is shown in FIG. 9 does not extend through the sidewall of the container below the flap 42 upon shipment. As shown in FIG. 9, the flap 42 is in a slightly raised position allowing the force concentrating member to remain slightly apart from the weakened portion of the container sidewall. The hinge 39 of the fitment 100 allows the flap 42 to be rotated along the hinge in the upward and downward direction. As is shown in FIG. 9, the force concentrating member 54 is provided so that, upon turning of the cap, which is not shown in these Figures, the cam contacts the cam follower 44 along the vertical surface 45*c* providing a horizontal force to act thereon pushing the force concentrating member downward against the weakened portion of the container. Force concentrating member 54 is thus provided to allow for less downward force which enables the flap to fully open the container and tear the weakened portion of the container there below.

Figure 10:
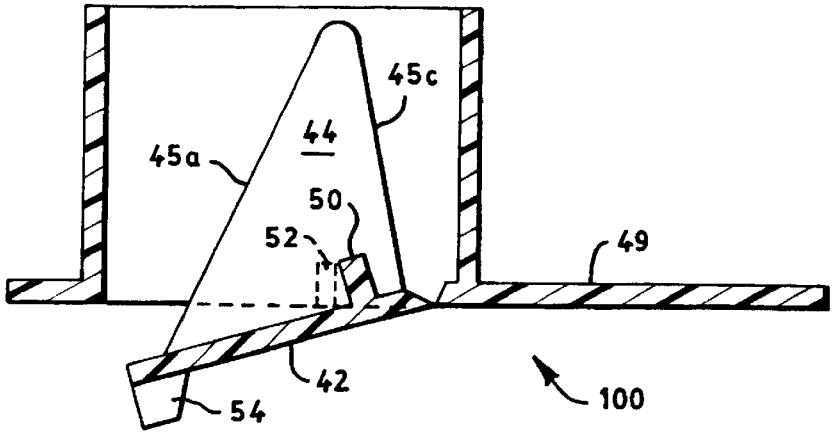
FIG. 10 is a side-sectional view of the pouring spout fitment of FIG. 7 partially opened.
Figure 11:
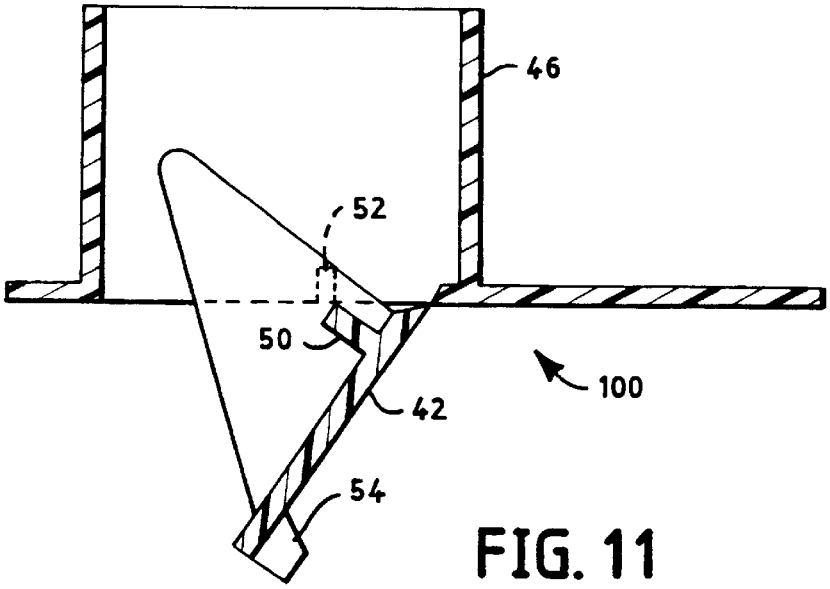
FIG. 11 is a sectional view of the pouring spout fitment of FIG. 7 in the fully opened position.

As can be seen in FIGS. 9, 10 and 11, the various positions of the flap during opening are shown. Initially, as shown in FIG. 9, the force concentrating member may be slightly above the weakened portion of the container side wall. In FIG. 10, as the cap is rotated in the counter clock wise direction causing the cam to act upon the top portion 45*b* of the cam follower, the flap rotates downward causing the force concentrating member 54 to extend through the weakened portion of the container sidewall. Further, as the flap is forced downward, shoulder 50 may contact stop member 52 and 53 and pass thereby. As the cam further rotates and forces the cam follower 44 downward even further, shoulder 50 snaps past the projections 52 and 53 due to this downward rotational movement. As shown in FIG. 11, the flap 42 is now maintained in the opened position allowing the contents of the container to pass through the opening and through the pouring zone defined by the annular sidewall 46 of the fitment.

While one embodiment of a cam follower 44 shown in the Figures is described herein to work in conjunction with a cam 24 depending from a cap top wall to engage said cam follower, it will be obvious to those of skill in the art that variations utilizing a spiral cam and cam follower can be incorporated in the herein disclosed automatically opening pour spout. The cam 24 of the present invention, which depends from top wall 22, may be varied so as to properly contact the cam follower and provide sufficient downward force so that the flap penetrates the sidewall of the container. While the embodiments shown herein work sufficiently to provide such downward force, other modifications thereof are possible and within the scope of the following claims.

What is claimed is:

1. An auto-opening fitment, comprising:

a fitment, said fitment having a base and an upstanding wall defining a pouring zone therein;

a flap hingedly retained within said pouring zone;

a cam follower extending upward from said flap, said cam follower having a back edge surface and a top surface, wherein said cam follower is aligned perpendicularly to a hinge;

a cap retained on said fitment, said cap having a top wall and a depending side wall, said top wall having a cam depending therefrom and engageable with said cam follower;

said cam engaging said cam follower on both said back edge surface and said top surface during rotation of said cap in a counterclockwise direction.

2. The fitment of claim 1 wherein said cam of said cap is a spiral cam.

3. The fitment of claim 2 wherein said spiral cam is further comprised of a center post extending downward from said top wall.

4. The fitment of claim 3 wherein said spiral cam extends clockwise around said center post and extending outward there from towards said side wall.

5. The fitment of claim 4 wherein said spiral cam has a driving face along said cam, said driving face extending downward from said center post to a lower portion thereof adjacent said side wall, said lower portion contacting said back edge surface during initial counterclockwise rotation of said cap to provide a horizontal force on said back edge surface, the remaining portion of said cam contacting said top surface during continued counterclockwise rotation of said cap.

6. The fitment of claim 1 wherein said flap has a hinge extending along a segment thereof and wherein said flap is bounded by a gap in between said flap and said upstanding wall, said gap allowing said flap to rotate about said hinge.

7. The fitment of claim 2 wherein said cam follower on said flap is triangular in shape.

8. The fitment of claim 2 further comprising a tamper indicating band frangibly connected to the lower edge of said side wall on said cap.

9. The fitment of claim 8 wherein said tamper indicating band is further comprised of at least one notch formed therein and engageable with at least one notch formed on said base of said fitment.

10. The fitment of claim 8 wherein said tamper indicating band is further comprised of four notches on said tamper indicating band, said notches engaging four notches formed on said base of said fitment.

11. The fitment of claim 2 wherein said cap has at least one thread formed on the interior of said side wall, said at least one thread engageable with at least one thread formed on said upstanding wall of said fitment.

12. The fitment of claim 2 further comprising a shoulder formed on said flap;

at least one stop member formed on said side wall of said fitment engagable with said shoulder when said shoulder rotates downward.

13. The fitment of claim 12 wherein said side wall of said fitment has a first stop member and a second stop member opposite each other on said side wall, each of said first and second stop member engageable with said shoulder to retain said flap in a downward position.

14. The fitment of claim 2 further comprising a force concentrating member extending downward from said flap.

15. A pouring fitment, comprising:

a base portion and an upstanding sidewall, said upstanding sidewall defining a pouring zone therein;

a flap having a hinge and rotatable within said pouring zone;

a cam follower extending upward from said flap, said cam follower having a substantially vertical surface and a top surface, wherein said cam follower formed on said flap and is aligned perpendicularly to a hinge;

a cap retained on said sidewall and rotatable thereon, said cap having a top wall and depending side wall and having a spiral cam extending downward from said top wall, said spiral cam engageable with said cam follower vertical surface and said cam follower top surface.

16. The fitment of claim 15 wherein said spiral cam has a center post and further wherein said spiral cam spirals outward clockwise from said center post to said side wall of said cap forming an engagement surface on said cam, said engagement surface of said cam initially operating on said vertical surface of said cam follower, said engagement surface of said cam subsequently operating on said surface of said cam as said cap rotates counterclockwise.

17. The fitment of claim 16 wherein said spiral cam decreases in height from said center post to said cap side wall.

18. The fitment of claim 16 wherein said cam follower extends upward from said flap in a triangular shape.

19. The fitment of claim 18 wherein said engagement surface contacts said cam on said substantially vertical portion as said cap is rotated counter clockwise.

20. The fitment of claim 15 further comprising a tamper indicating band frangibly connected to said cap, at least one engageable post formed on said base portion, said at least one engageable post aligned with at least one notch formed in said tamper indicating band.

21. The fitment of claim 15 further comprising a projection on said flap, said projection engageable with at least one stop member formed in said pouring zone.

22. The fitment of claim 21 wherein said shoulder extends upwards from said flap adjacent said hinge and further wherein said at least one stop member is comprised of a first and a second stop member extending inwards from said upstanding side wall.

23. The fitment of claim 15 further comprising a force concentrating member formed on said flap and extending downward therefrom.

24. A pour spout fitment, comprising:

a base portion having an upstanding side wall defining a space therein;

a flap having a hinge, said flap rotatable about said hinge within said space formed by said upstanding side wall;

a cam follower formed on said flap and extending upward therefrom, said cam follower having a vertical contacting surface and a top portion;

a cap retained on said side wall and rotatable thereon;

a spiral cam depending from said side wall, said spiral cam engagable with said vertical contacting surface and said top portion of said cam follower as said cap is rotated.

25. The pour spout fitment of claim 24 wherein said cam follower is triangular in shape.

26. The pour spout fitment of claim 24 further including a first stop member extending inward from said upstanding side wall;

a shoulder formed on said flap, said shoulder engageable with said first stop member when said flap is rotated about said hinge.

27. The pour spout fitment of claim 26 wherein said shoulder is rectangular in shape and extends upwards from said flap along said hinge.

28. The pour spout fitment of claim 27 further including a second stop member extending inward from said side wall, said first stop member contacting said shoulder at one end and said second stop member contacting said shoulder at the opposite distal end.

* * * * *